United States Patent [19]

Thomsen

[11] Patent Number: 4,760,920

[45] Date of Patent: Aug. 2, 1988

[54] EARRING PURSE

[76] Inventor: Victoria Thomsen, 4211 W. Simpson Dr., Meadowood, Dunlap, Ill. 61525

[21] Appl. No.: 927,674

[22] Filed: Nov. 6, 1986

[51] Int. Cl.[4] ..... B65D 85/00

[52] U.S. Cl. ..... 206/495; 150/52 R; 150/131

[58] Field of Search ..... 63/1, 2, 12; 150/52 C, 150/52 R, 113, 116, 131, 147–153; 190/16, 17, 100, 110, 119, 124, 29, 31; 206/566, 493

[56] References Cited

U.S. PATENT DOCUMENTS

| | | | |
|---|---|---|---|
| 3,125,221 | 3/1964 | Ax | 206/566 |
| 3,525,376 | 8/1970 | Muhlhauser | 150/52 |
| 3,900,060 | 8/1975 | Shammas | 150/52 R |
| 4,401,219 | 8/1983 | Mink | 206/566 |
| 4,465,179 | 8/1984 | Miller | 206/37 |
| 4,488,645 | 12/1984 | Yamaguchi | 206/312 |
| 4,606,458 | 8/1986 | LaBate | 206/566 |

FOREIGN PATENT DOCUMENTS

| | | | |
|---|---|---|---|
| 0323927 | 1/1930 | United Kingdom | 206/566 |
| 0656638 | 8/1951 | United Kingdom | 150/52 R |

*Primary Examiner*—Jimmy G. Foster

*Attorney, Agent, or Firm*—Wood, Dalton, Phillips, Mason & Rowe

[57] ABSTRACT

An earring purse which includes a stiff foraminous panel for mounting post earrings keeps the earrings organized and prevents collisions. The stiff panel is rectangular and attaches to the inside of a rectangular protective cover along one of its edges. In the closed position, the protective cover folds over the stiff panel and attaches to itself by a fastening means comprising Velcro strips located at both ends of the protective cover. The protective cover opens into a single flap allowing the stiff panel to be lifted up for convenient posting and retrieval of earrings.

9 Claims, 1 Drawing Sheet

EARRING PURSE

FIELD OF THE INVENTION

This invention relates to a purse for organizing and storing post earrings for those who have pierced ears.

BACKGROUND OF THE INVENTION

There are a number of containers available for storing jewelry, including earrings. Perhaps the most common is the compartmentalized jewelry box. Because of weight and size, jewelry boxes for the most part must be kept in one place, such as a dresser drawer, and are inconvenient to carry around.

Various jewelry containers have been proposed which can be carried around. For the most part, these are constructed of layers of soft fabric material sewn together as a purse or pouch. While containers of this construction are lightweight and easy to carry around, two significant problems remain. First of all, the jewelry becomes mixed together and disorganized. Secondly, the jewelry items collide with each other causing damage.

The problem of disorganization has been solved to some extent by compartmentalizing the soft fabric jewelry containers. For postable jewelry items, such as post earrings, ths problem has also been solved by sewing a layer of soft fabric posting material to the inside of a jewelry purse. Neither of these designs prevents the jewelry items from striking each other however. Collisions can be prevented by supporting the posting material with a rigid frame, but this adds weight and prevents fastening the posting material inside a purse because of difficult retrieval of earrings.

The present invention provides an earring purse which prevents collisions between postable earrings without adding weight or sacrificing convenience.

SUMMARY OF THE INVENTION

It is the principal object of the invention to provide a new and improved earring purse. More specifically, it is an object of the invention to provide a new and improved earring purse that separates postable earrings and prevents them from colliding with one another, is lightweight, is easy to carry around and provides for convenient retrieval of earrings.

The advantages of the invention are accomplished by utilizing a stiff panel, preferably with holes, for receiving the earring posts. This renders unnecessary a rigid frame, making the earring purse more appealing and easy to carry in a suitcase or in a ladies' purse. The stiff panel with holes is fastened to the inside of an outer protective cover.

In a preferred embodiment of the invention, the stiff panel with holes comprises a foraminous fabric stiffener such as used in drapery headings. This allows the stiff panel to have very little weight increase over the soft fabric material of the prior art.

In a further preferred embodiment of the invention, the protective cover to which the stiff panel is fastened comprises soft fabric. This causes the entire purse to have light weight and appealing texture and physical appearance.

In a further preferred embodiment of the invention the protective cover opens into a continuous flap. This makes it easy to organize the earrings and convenient to retrieve them.

These objects and advantages will become apparent from the following specification taken in connection with the accompanying drawings.

DESCRIPTION OF THE PREFERRED EMBODIMENT

Figure 1:
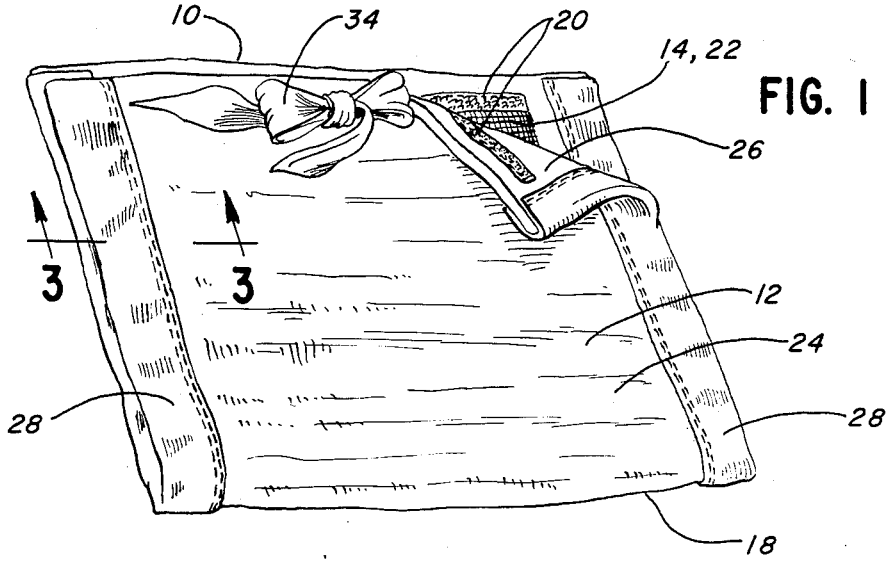
FIG. 1 is a perspective view of a purse of the invention in its closed position, with the upper right hand corner peeled open and folded back.

An exemplary embodiment of the earring purse, generally designated 10, is illustrated in the drawings.

The earring purse 10 includes an outer protective cover 12 with a stiff panel 14 attached thereto. Post earrings 16 are mounted to stiff panel 14. Protective cover 12 is rectangular in shape and has a fold 18 at the center extending the width for enclosing stiff panel 14. Velcro strips 20 at both ends of protective cover 12 hold earring purse 10 in its closed position, as shown in FIG. 1.

Figure 2:
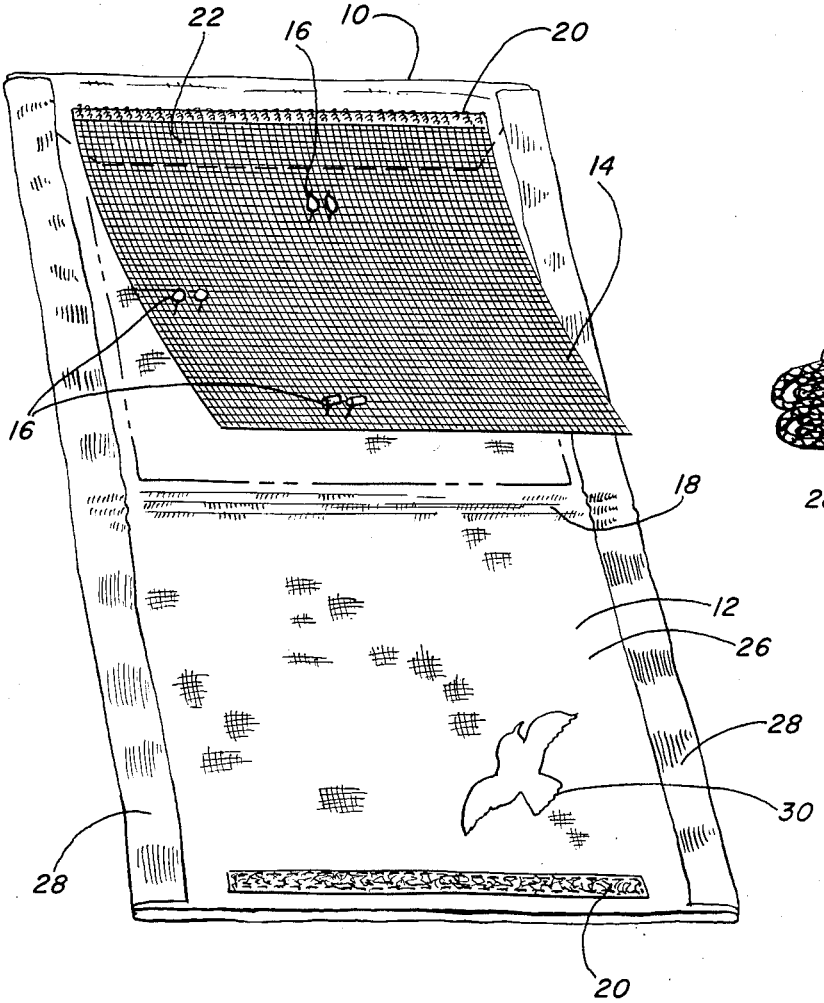
FIG. 2 is a perspective view of the purse in its fully open position, with the stiff panel lifted up slightly.

Stiff panel 14 preferably comprises a rectangular section of foraminous fabric stiffener of a kind typically used in drapery headings. Stiff panel 14 is attached to protective cover 12 along outer edge 22 and extends almost to the center fold 18. As shown in FIG. 2, stiff panel 14 may be lifted from its rest position shown by the dashed lines to facilitate easy posting and retrieval of earrings.

Figure 3:
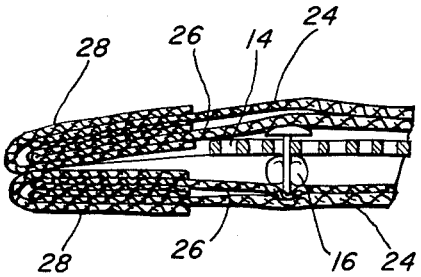
FIG. 3 is an enlarged fragmentary section view taken along line 3—3 in FIG. 1.

FIG. 3 demonstrates the posting of earrings 16 to stiff panel 14. An earring 16 is held in place by its post which passes through an opening in panel 14. Panel 14 separates earrings 16 and prevents them from colliding with one another. Inner layer 26 of protective cover 12 provides durability to protect earrings 16 from damage caused by collision with external objects.

Stiff panel 14 is not limited to the foraminous fabric stiffener shown but may comprise any stiff material including wire mesh screen, punchboards and woven or knit fabrics. The only requirement other than stiffness is that the panel 14 either has holes for receiving earring posts or is made of a material through which earring posts can be punched.

Protective cover 12 is made of soft fabric and includes two layers, an outer layer 24 of decorative design for aesthetic appeal and an inner layer 26 comprising a closely woven fabric for durability. Decorative bands 28 are folded over the longitudinal edges of protective cover 12 and are sewn to both outer layer 24 and inner layer 26 of protective cover 12. Decorative bands 28 provide aesthetic appeal and hold outer layer 24 and inner layer 26 together.

A decorative emblem 30 is attached to inner layer 26 of protective cover 12. A decorative ribbon 34 is attached to outer layer 24.

While protective cover 12 is preferably made of soft fabric to minimize weight and provide aesthetic appeal, other materials may also be used. Possible substitutes include vinyl plastics, leather, or any material suitable for the manufacture of purses.

I claim:

1. A purse for posting and storing post earrings which comprising:

a rectangular outer protective cover having a fold at the center of said cover extending the width of said cover, said cover defining opposite end portions and having Velcro fastening means fixed to said end portions for holding said end portions together in a closed arrangement of the purse; and a stiff rectangular panel with holes for individually receiving earring posts attached to said protective cover along one of said end portions adjacent said fastening means and extending a major portion of the distance from said one of said end portions toward said center fold of said protective cover, said panel being accessible in an open arrangement of the purse.

2. The purse of claim 1 wherein said panel is formed of a stiff a fabric.

3. The purse of claim 1 wherein said cover is formed of a fabric.

4. The purse of claim 1 wherein said protective cover is formed of soft fabric.

5. The purse of claim 1 wherein said fold extends substantially the width of said cover.

6. The purse of claim 1 wherein said fastening means comprises Velcro strips.

7. The purse of claim 1 wherein said protective cover has an inner layer comprising a durable closely woven fabric and an outer decorative layer.

8. The purse of claim 1 in which said panel is generally rectangular and said cover is generally rectangular.

9. A purse for posting and storing post earrings which comprises:

(a) a rectangular outer protective cover having a fold at the center of said cover extending the width of said cover, said cover defining end portions and having Velcro fastening means strips fixed at both thereof for holding said ends together, and (b) a stiff rectangular panel with holes for receiving earring posts attached to said protective cover along one of said end portions adjacent said fastening means and extending almost to said center fold of said protective cover.

* * * * *